US005676408A

United States Patent [19]

Davidian

[11] Patent Number: 5,676,408

[45] Date of Patent: Oct. 14, 1997

[54] POCKET DOOR LATCH

[75] Inventor: Richard M. Davidian, Kensington, Conn.

[73] Assignee: The Stanley Works, New Britain, Conn.

[21] Appl. No.: 719,206

[22] Filed: Sep. 25, 1996

Related U.S. Application Data

[63] Continuation of Ser. No. 328,576, Oct. 21, 1994, abandoned.

[51] Int. Cl.[6] ..... E05C 3/06

[52] U.S. Cl. ..... 292/197; 292/DIG. 46

[58] Field of Search ..... 292/197, 203, 292/224, 229, DIG. 31, 46, 60, 63, 64, 98, 99, 108, 195, 198, 210, DIG. 46

[56] References Cited

U.S. PATENT DOCUMENTS

| | | | |
|---|---|---|---|
| 235,793 | 12/1880 | McCurdy | 292/63 |
| 1,038,624 | 9/1912 | Messick | 292/63 |
| 3,065,985 | 11/1962 | Du Four | 292/DIG. 46 |
| 4,024,739 | 5/1977 | Kaufman | 292/DIG. 46 |
| 4,480,862 | 11/1984 | Fleming | 292/162 |
| 4,643,005 | 2/1987 | Logas | 70/95 |
| 5,184,853 | 2/1993 | Whatley | 292/205 |

*Primary Examiner*—Steven N. Meyers
*Assistant Examiner*—Gary Estremsky

[57] ABSTRACT

A pocket door latch assembly has a housing with a latch arm pivotally mounted therewithin. The latch arm has a latch nose at one end and an inverted generally V-shaped slot adjacent its other end, and the arm is pivotable between a first position wherein it is entirely within the housing and a second position wherein the latch nose extends outwardly of the housing. An actuator has a portion slidable within the slot between a first position adjacent the one end of the arm and a second position spaced from the one end to pivot the latch arm between its first and second positions. The actuating means is manipulable outwardly of the housing to slide the slidable portion of the actuating means within the slot between its first and second positions, thereby pivoting the latch arm between its positions.

17 Claims, 4 Drawing Sheets

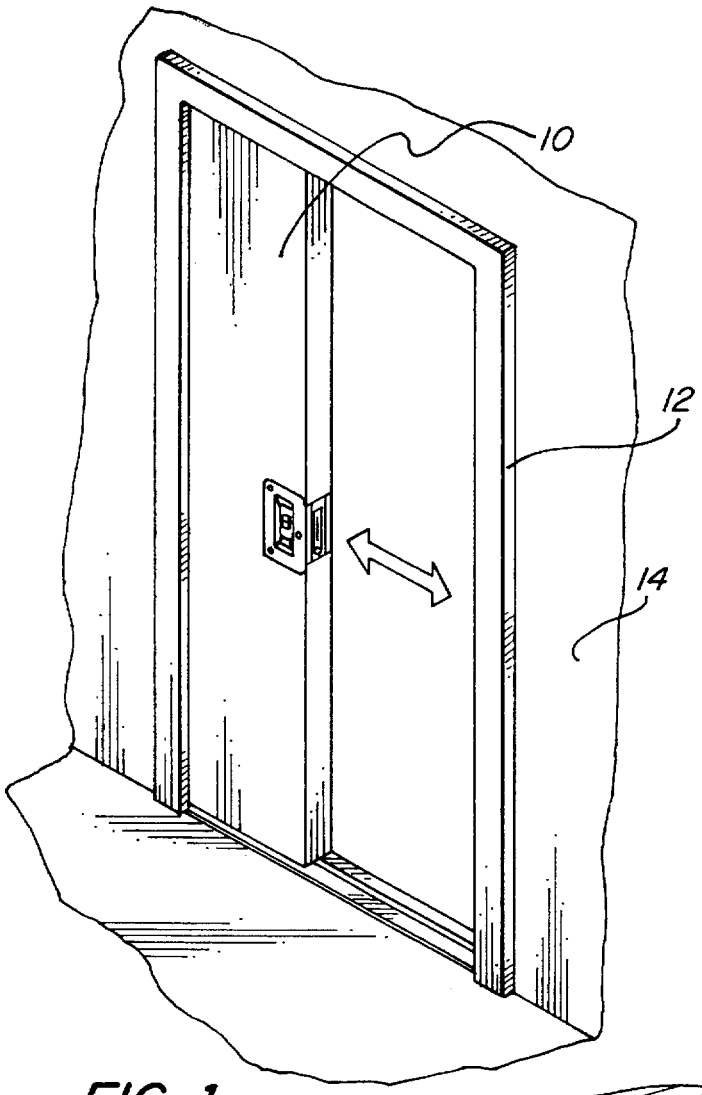
FIG. 1
FIG. 2
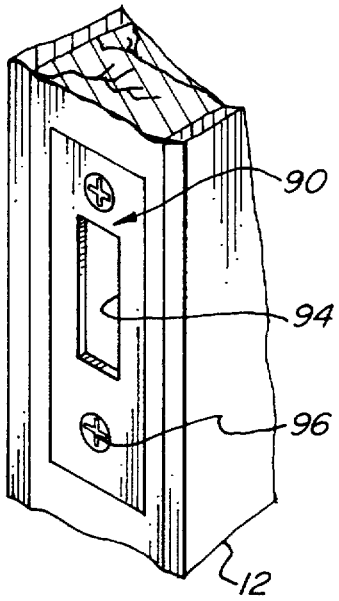
FIG. 3
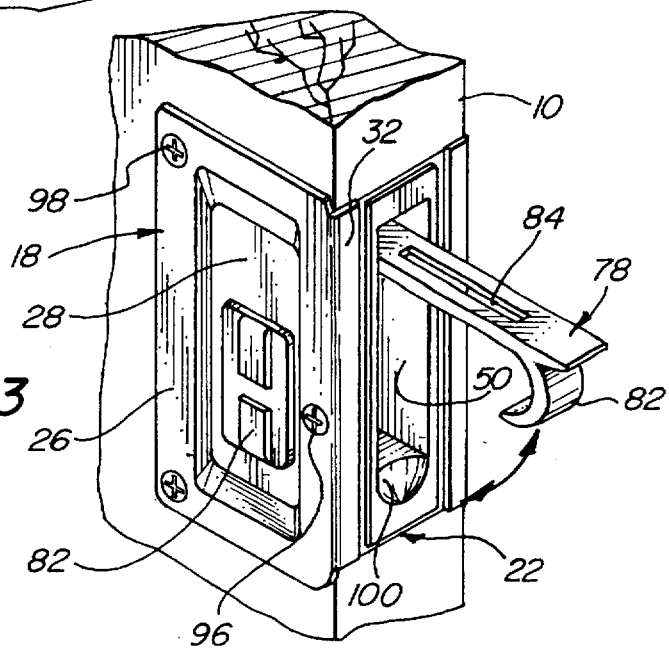

POCKET DOOR LATCH

This is a continuation of U.S. patent application Ser. No. 08/328,576 filed on Oct. 21, 1994, now abandoned.

BACKGROUND OF THE INVENTION

The present invention relates to a latch assembly for a pocket door, and, more particularly, to a latch assembly having a slide actuator.

A pocket door is typically used where swinging doors are not practical and, because the door slides into a pocket in the wall, the latches must be substantially flush with the face of the door. Ideally, this latch should aesthetically blend with the appearance of the door. If the external parts of the latch assembly are large, aesthetics are generally sacrificed but there is a need to effect sufficient motion of the actuator to move the latch arm into and from engagement with the strike on the door frame.

Unlike the latch assembly for an entry door, a pocket door latch assembly does not require a key lock, but it should be manipulable on both sides of the door and ideally in the same manner to latch or unlatch the door.

Moreover, because pocket doors vary in thickness, it is desirable that the latch assembly be adaptable for installation on pocket doors of various thicknesses.

It is an object of the present invention to provide a novel pocket door latch which requires only limited movement of the actuator to effect the pivoting of the latch arm between latched and unlatched positions.

It is also an object to provide such a pocket door latch which is actuatable on either side of the pocket door by the same type of manipulation of the actuator.

It is a further object to provide such a pocket door latch which is adjustable to accommodate doors of various thicknesses.

SUMMARY OF THE INVENTION

It has now been found that the foregoing and related objects may be readily attained in a latch assembly for use with a pocket door and door frame comprising a housing adapted to be mounted on a pocket door adjacent the latch end thereof, and a latch arm pivotally mounted within the housing and having a latch nose at one end. The latch arm has an inverted generally V-shaped slot adjacent the other end, and the arm is pivotable between a first position wherein it is entirely within the housing and a second position wherein the latch nose extends outwardly of the housing and beyond the edge of the door in which it is mounted.

The latch arm is pivotable by actuating means having a portion slidable within the slot between a first position adjacent the one end of the arm and a second position spaced from the one end to pivot the latch arm between its first position and its second position, and the actuating means includes manipulatable elements outwardly of the housing to slide the slidable portion of the actuating means within the slot between its first and second positions, thereby pivoting the latch arm. between its the first and second positions.

The latch assembly also includes a strike for mounting on the door frame and engageable with the latch nose when the latch arm is in the second position.

Desirably, the upper edge of the slot provides an upper cam surface and the lower edge of the slot provides a lower cam surface, and the slidable portion of the actuating means is slidable along the upper cam surface from its first position adjacent the one end of the arm to its second position spaced from the one end to pivot the latch arm from the first position to the second position. The slidable portion is slidable along the lower cam surface from its second position adjacent the one end to its first position spaced from the one end to pivot the latch arm from the second position to the first position.

The housing includes a front wall having a slot therein, a back wall having a slot therein, an end wall, and a frame within the several walls and providing a pivot for the latch arm. The outer surface of the end wall is adapted to be mounted generally coplanar with the edge surface of the pocket door. The frame also provides means limiting the pivoting of the latch arm to the first and second positions.

The actuating means includes an intermediate elongated portion providing the slidable portion and the manipulable elements at each end extending through the slots in the front and back walls which are manipulatable to slide the slidable portion within the inverted V-shaped slot, thereby pivoting the latch arm between the first and second positions. Each of the manipulatable elements includes a projecting portion to facilitate manipulation of the actuating means.

The elongated portion of the actuating means extends between the front and back walls and through the inverted V-shaped slot, and comprises a pair of telescoping elements to allow the distance between the front and back walls to vary while maintaining the elongated elements in engagement.

Desirably, the latch assembly includes biasing means within the housing connected to the latch arm to provide an over center toggle to bias the latch arm towards the first and second positions.

BRIEF DESCRIPTION OF THE DRAWINGS

FIG. 1 is a fragmentary perspective view of a wall with a pocket door installation including the latch assembly embodying the present invention;

FIG. 2 is a fragmentary perspective view drawn to an enlarged scale of the latch side of the door frame with the strike thereon;

FIG. 3 is a perspective view of a portion of the door with the latch assembly drawn to an enlarged scale and with the pull pivoted into its operative position;

DETAILED DESCRIPTION OF THE ILLUSTRATED EMBODIMENT

Figure 4:
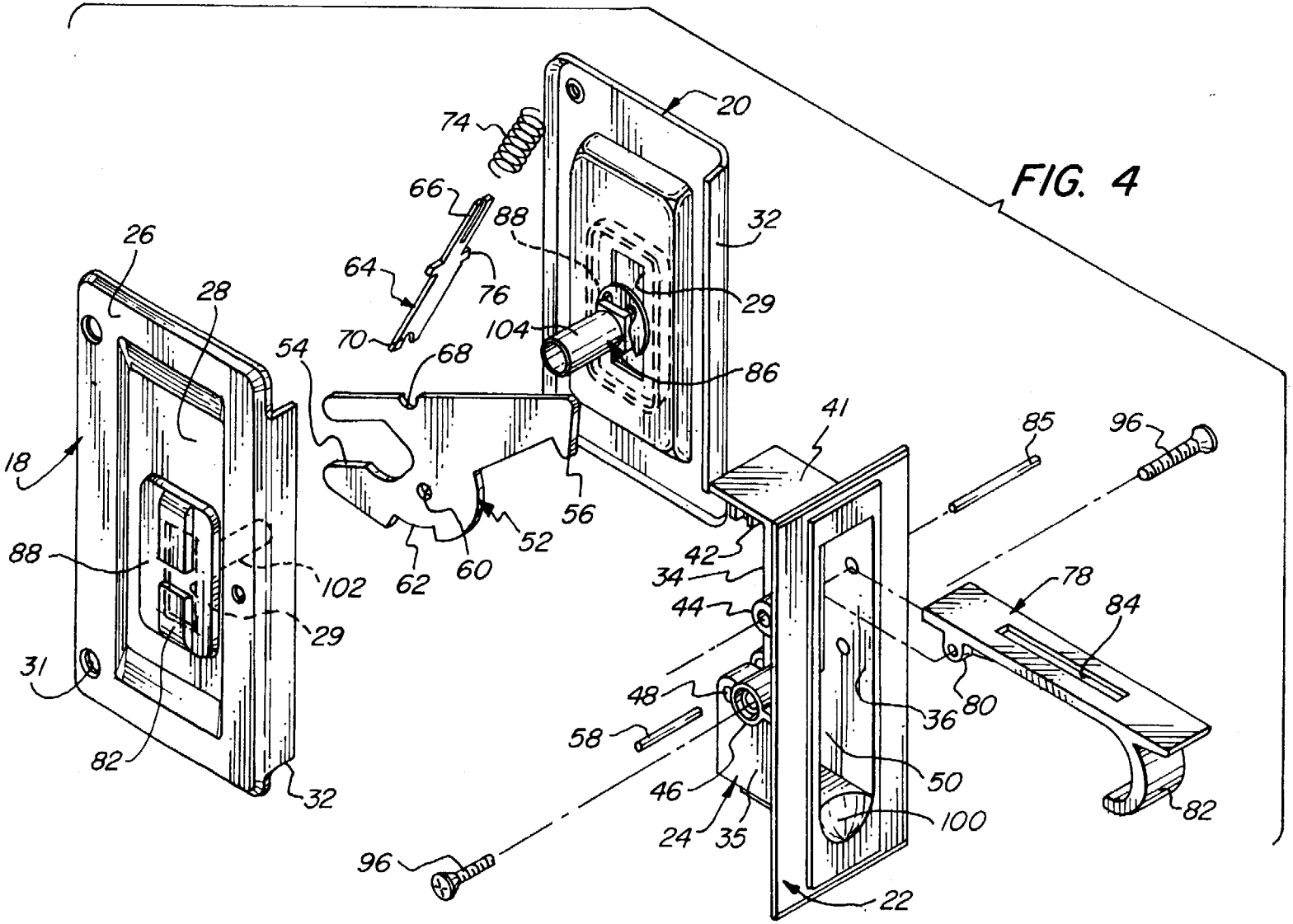
FIG. 4 is an exploded view of the portion of the latch assembly mounted on the door.

Turning first to FIG. 1, therein illustrated is a pocket door installation embodying the present invention. The pocket door 10 is shown in a partially open position in the opening in the wall 14 about which the frame 12 extends. The pocket in the wall 14 is to the left side of the opening as seen in FIG. 1.

As seen in FIG. 2, the strike plate generally designated by the numeral 90 is mounted on the latch side of the frame 12 by the fasteners 96. It has a slot 94 therein and is disposed over a cavity 92 in the frame 12.

As seen in FIG. 3, the latch component of the assembly has a housing formed by the front wall plate generally designated by the numeral 18, the rear wall plate generally designated by the numeral 20, and the end wall plate generally designated by the numeral 22. Integrally cast with the end wall plate 22 is the frame generally designated by the numeral 24. In this view, the pull generally designated by the numeral 78 is shown in the extended position so that the door 10 may be pulled out of the pocket in the wall 14.

Figure 6:
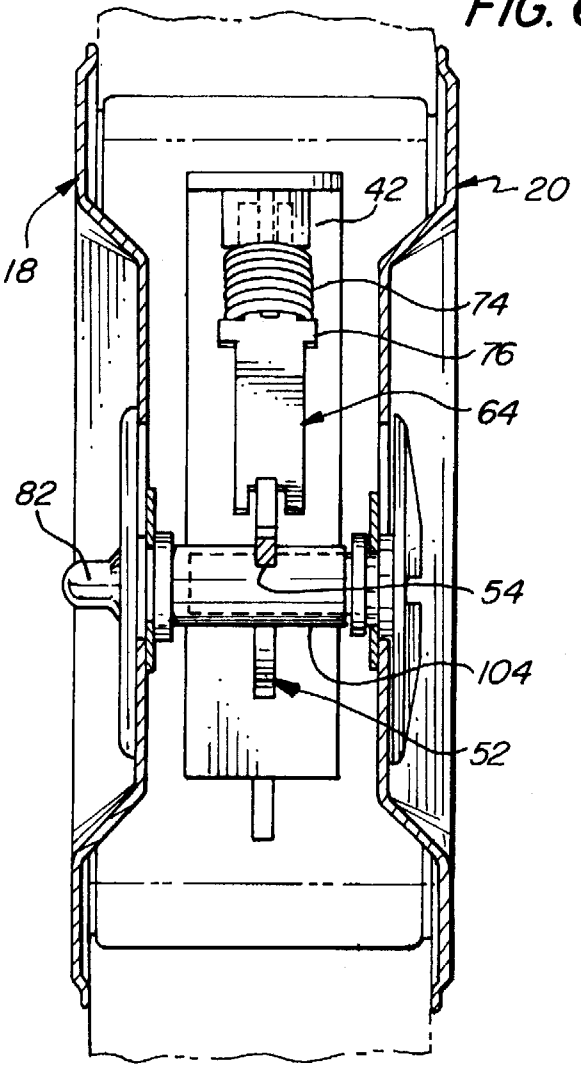
FIG. 6 is a sectional view thereof along the line 6—6 of FIG. 5.
Figure 5:
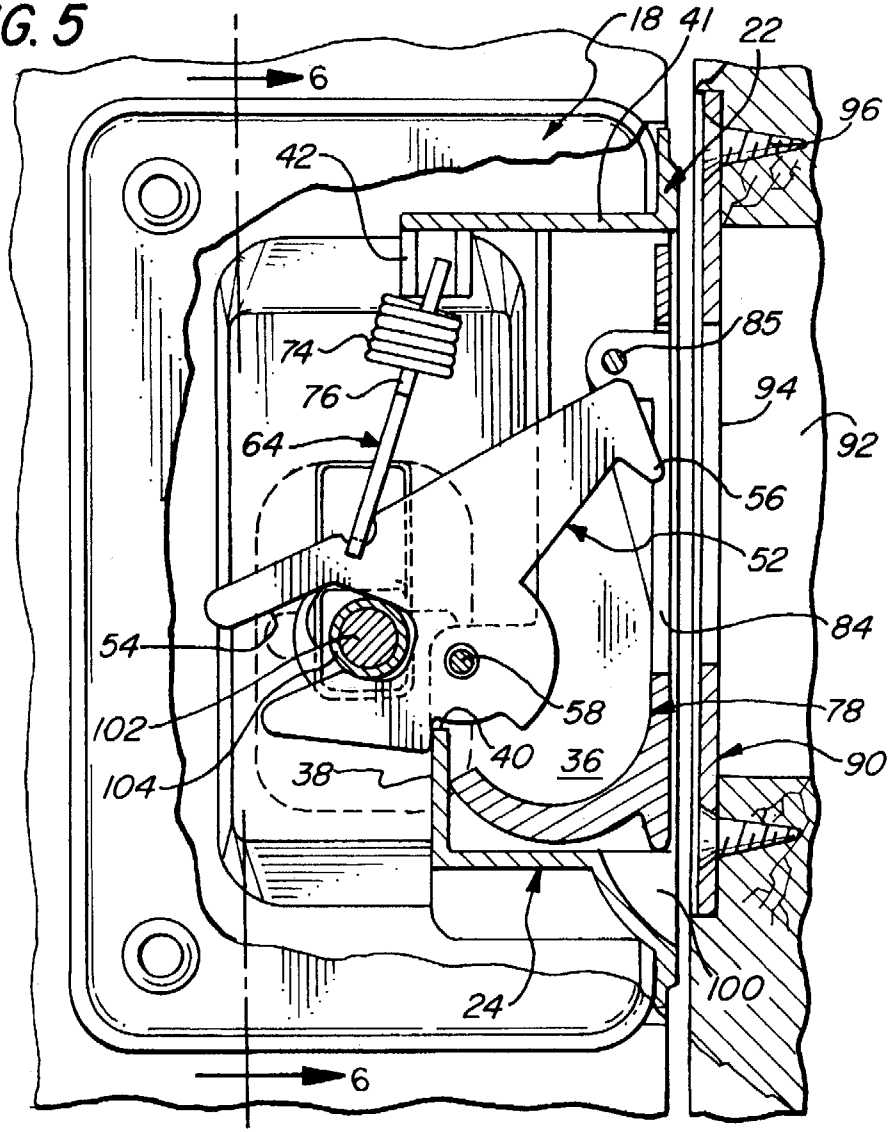
FIG. 5 is a side elevational view with the door in the closed position and with the assembly in the unlatched position, drawn to an enlarged scale and with portions of the housing and strike broken away.
Figure 7:
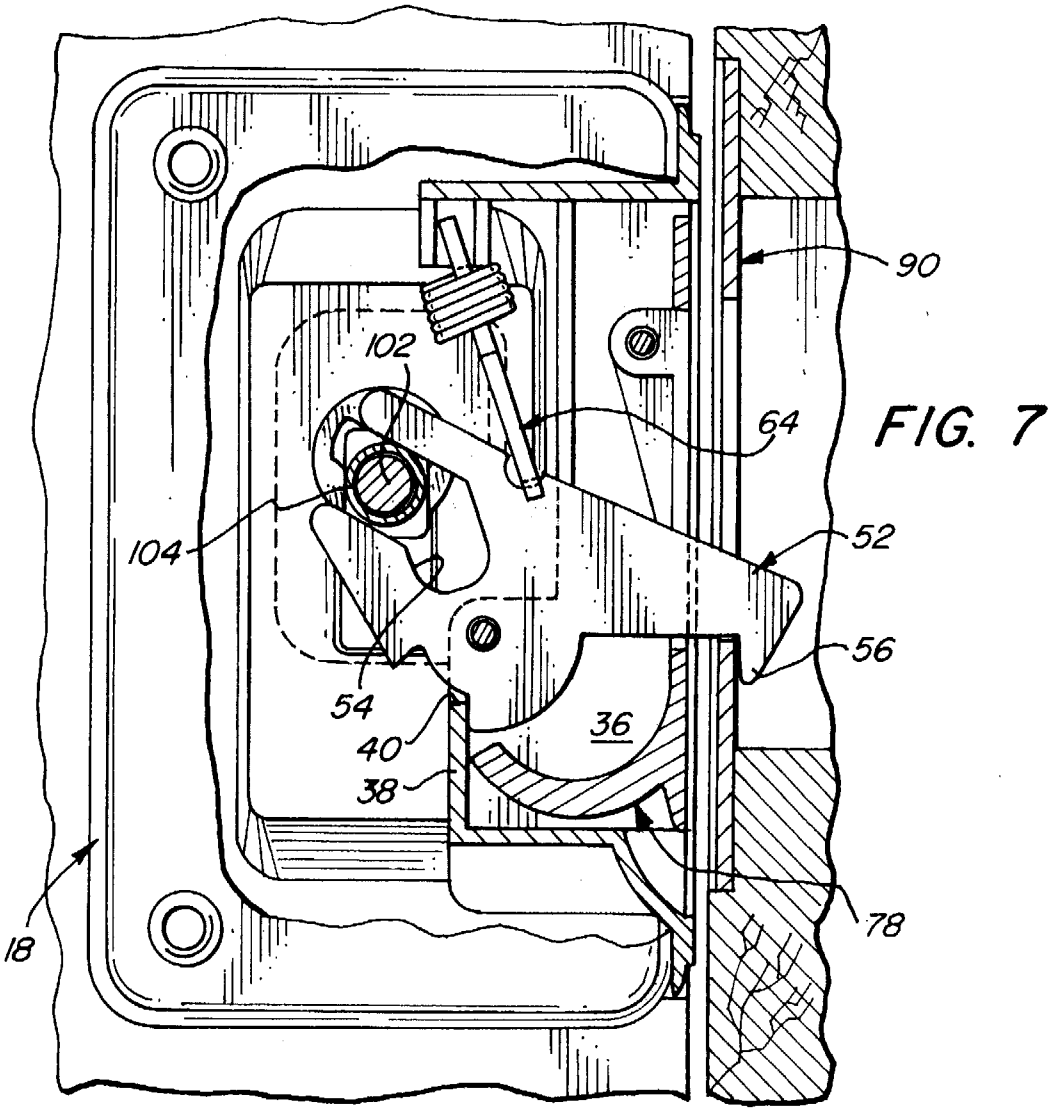
FIG. 7 is a view similar to FIG. 5, showing the latch arm engaged in the strike plate.

Turning first in detail to the front and rear wall plates 18 and 20, respectively, they are of identical construction and have a generally planar peripheral portion 26 and a recessed central portion 28 with a vertically extending slot 29 therein (seen in FIGS. 5–7). Along the forward edge thereof is a vertically extending lip 32 which overlies the end wall plate 22, and an aperture 29 adjacent the forward edge seats the fastener 51 to secure the wall plate 18, 20 to the frame 24. Fasteners 98 seated in the apertures 31 secure the plates 18, 20 to the door 10.

Turning in detail next to the frame 24, it provides a box-like structure with side walls 36 and a rear wall 38. The frame 24 has a relatively deep section 35 at its lower end and a shallower section 34 at its upper end, and the rear wall 38 terminates prior to the upper end wall 41. A slot 40 extends longitudinally of the rear wall 38 in the shallower section 34 and into the deeper section 35. The upper end wall 41 extends beyond the plane of the rear wall 38 and has a bracket 42 adjacent the end thereof. Bosses 44 and 46 are provided along the side walls 36 of the sections 34 and 35.and pivot apertures 48 are provided in the deep side walls of the section 35. The box sections 34, 35 provide a cavity 50 which opens at the end wall plate 22, and a shallow recess 100 is provided below the deeper section 35. In the cavity 50 are located the various operating elements. The fasteners 51 extend through the plates 18, 20 and threadably seat in the bosses 46 to secure them to the frame 24.

The latch arm generally designated by the numeral 52 is disposed within the cavity 50 and slot 40, and it has, at one end, the hook-shaped nose 56, and, adjacent the other end an inverted generally V-shaped slot generally designated by the numeral 54. Intermediate the length of the generally rectilinear upper edge of the arm 52 is a notch 68, and the central portion of the latch arm 52 is enlarged with a generally arcuate lower edge portion having a notch 62 therein. A pivot aperture 60 is provided in the enlarged portion forwardly of the V-shaped slot 54 and seats the pivot pin 58 which also seats in the pivot apertures 48 of the frame 24. Because the slot 40 extends through a portion of the rear wall 38 of the deeper section 35, an edge of the rear wall 38 rides in the notch 62 to limit the pivotal motion of the latch arm 52. As a result, the latch arm 52 pivots over an arc within the frame 24 and its slot 40, as will be described more fully hereinafter.

A lever generally designated by the numeral 64 has bifurcated ends 66, 70, one of which seats in the notch 68 in the latch arm 52 and the other of which seats in the bracket 42 on the frame 24. A compression coil spring 74 is disposed about the lever 64 and acts between the bracket 42 and the shoulders 76 on the lever 64 so as to bias the latch arm 52 into its pivoted positions.

Also disposed within the cavity 50 of the frame 24 is the elongated pull generally designated by the numeral 78 having a pivot boss 80 adjacent its upper end and an arcuate finger grip 82 adjacent its lower end. The pull 78 is pivotally mounted in the frame 24 by the pivot pin 85 which extends through the bosses 44 of the frame 24 and the pivot boss 80. Intermediate the length of the pull 78 is a slot 84 through which the latch arm 52 extends.

To effect movement of the latch arm 52, there is provided an actuator assembly generally designated by the numeral 86 which includes slide buttons 88 slidably seated in the apertures 29 of the wall plates 18 and 20 and telescoping post elements 102 and 104 which extend therebetween. As can be seen, the post elements 102, 104 extend through, and are slidable in, the V-shaped slot 54 in the latch arm 52. Vertical motion of the actuator slide buttons 88 will cause the post elements 102, 104 to bear against the upper or lower edge surfaces of the slot 54 and produce pivotal motion of the latch arm 52.

In its at rest position, the latch arm 52 is fully disposed within the housing. In this position, the actuator buttons 88 are at the lower end of the apertures in the plates 18, 20 and the telescoping post elements 102, 104 extend through the V-shaped slot 54 adjacent its forward end. The over center toggle provided by the lever 64 and spring 74 biases the latch arm 52 to retain it in this position.

If the door 10 is in the pocket within the wall 14, a finger can be moved into the recess 100 adjacent the lower end of the end plate 22 to engage the finger grip 82 to pivot the pull 78 outwardly of the end plate 22 into the position seen in FIG. 3. The pull 78 can then be firmly gripped to pull the door 10 outwardly of the pocket.

When the door 10 is moved into a position against the latch side of the frame 12, it may be latched in this position by moving the slide buttons 88 upwardly. This causes the post elements 102, 104 to bear against the upper edge of the slot 54 and pivot the latch arm 52 about the pivot pin 58. The post elements 102, 104 act against the cam surface provided by the upper edge of the slot 54 as they move to the rearward leg of the slot 54. As the latch arm 52 is pivoting, the over center toggle provided by the lever 64 and spring 74 biases the latch arm 52 into the position seen in FIG. 7 to engage its nose 56 in the slot 94 of the strike plate 90. As the latch arm 52 pivots, it passes outwardly through the slot 84 in the pull 78.

To unlatch the door 10, the slide buttons 88 are moved downwardly and the post elements 102, 104 bear against the lower edge of the slot 54 to pivot the latch arm 52 upwardly until they enter into the forward leg of the slot 54. Again the toggle action of the lever 64 and spring 74 biases the latch arm 52 into the position seen in FIG. 5.

As will be readily appreciated, the V-shaped configuration of the slot 54 effects relatively a large amount of pivotal action with a relatively small amount of vertical motion of the slide buttons 88. This enables the latch assembly to be relatively compact in overall dimensions and improve the aesthetics of the pocket door installation.

The components of the latch assembly may be readily fabricated by stamping and casting, and they may be readily assembled. The configuration of the housing may be easily varied as may be the configuration of the various components.

Thus, it can be seen from the foregoing detailed specification and attached drawings that the latch assembly of the present invention provides a desirable compact appearance and is readily fabricated and assembled. The latching and unlatching action is effected readily by a limited amount of vertical motion of the easily manipulated slide buttons.

Having thus described the invention, what is claimed is:

1. A latch assembly for use with a pocket door and door frame comprising:

(a) a housing adapted to be mounted on an associated pocket door adjacent the latch end surface thereof;

(b) a latch arm pivotally mounted within said housing and having a depending latch nose at one end, said latch arm having an inverted generally V-shaped slot adjacent the other end and being pivotable downwardly between a first position wherein it is entirely within said housing and a second position wherein said latch nose extends outwardly of said housing beyond the end surface of the associated door; and (c) actuating means having a portion slidable within said slot between a first position adjacent the end of slot adjacent said one end of said arm and a second position adjacent the end of the slot spaced from said one end of said arm to pivot said latch arm between said first position and said second position, said actuating means having manipulatable elements outwardly of said housing supported thereon for linear sliding movement to slide said slidable portion of said actuating means rectilinerly and to effect pivotal movement of said latch about its pivot so that said slidable portion moves within said slot between its first and second positions, thereby multiplying the motion of said latch arm relative to the linear motion of said portion of said actuating means in said slot and converting the linear movement of said manipulatable elements and said slidable portion of said actuating means within said slot into pivoting of said latch arm between said first and second positions.

2. The latch assembly in accordance with claim 1 wherein there is included a strike for mounting on the associated door frame and engageable with said latch nose when said latch arm is in said second position.

3. The latch assembly in accordance with claim 1 wherein the upper edge of said V-shaped slot provides an upper cam surface and the lower edge of said slot provides a lower cam surface, and wherein said slidable portion of said actuating means is slidable along said upper cam surface from said first position adjacent said one end of said arm to said second position spaced from said one end of said arm to pivot said latch arm from said first position to said second position, said slidable portion being slidable along said lower cam surface from its second position to its first position to pivot said latch arm from said second position to said first position.

4. The latch assembly in accordance with claim 1 wherein said housing includes a front wall having a slot therein, a back wall having a slot therein, an end wall, and a frame within said walls providing a pivot for said latch arm, and the outer surface of said end wall being adapted to be mounted generally coplanar with the end surface of the associated pocket door.

5. The latch assembly in accordance with claim 4 wherein said frame provides means limiting the pivoting of said latch arm between said first and second positions.

6. The latch assembly in accordance with claim 4 wherein said actuating means includes an intermediate elongated portion providing said slidable portion and manipulatable elements at each end extending through said slots in said front and back walls with said manipulatable elements being manipulatable to slide said slidable portion within said inverted V-shaped slot, thereby pivoting said latch arm between said first and second positions.

7. The latch assembly in accordance with claim 6 wherein each of said manipulatable portions includes a projecting portion to facilitate manipulation of said actuating means.

8. The latch assembly in accordance with claim 1 wherein said slidable portion of said actuating means extends between said front and back walls and through said inverted V-shaped slot, and comprises a pair of telescoping members.

9. The latch assembly in accordance with claim 1 including biasing means connected to said latch arm to provide an over center toggle to bias said latch arm into said first and second positions.

10. The latch assembly in accordance with claim 1 wherein there is included a pull pivoted within said housing and having a slot through which said latch arm is pivotable into said second position.

11. A latch assembly for use with a pocket door and door frame comprising:

(a) a housing adapted to be mounted on an associated pocket door adjacent the latch end surface thereof, said housing including a front wall having a slot therein, a back wall having a slot therein, an end wall, and a frame within said walls, and the outer surface of said end wall being adapted to be mounted generally coplanar with the end surface of the associated pocket door;

(b) a latch arm pivotally mounted on said frame within said housing and having a latch nose at one end, said latch arm having an inverted generally V-shaped slot adjacent the other end and being pivotable between a first position wherein it is entirely within said housing and a second position wherein said latch nose extends outwardly of said housing beyond the end surface of the associated door, the upper edge of said V-shaped slot providing an upper cam surface and the lower edge of said slot providing a lower cam surface;

(c) actuating means having a portion slidable within said slot along said upper cam surface from a first position adjacent said one end of said arm to a second position spaced from said one end of said arm to pivot said latch arm from said first position to said second position, said slidable portion being slidable along said lower cam surface from its second position to its first position to pivot said latch arm from said second position to said first position, said actuating means having manipulatable elements outwardly of said housing supported thereon for linear sliding movement to slide said slidable portion of said actuating means rectlinearly and to effect pivotal movement of said latch about its pivot so that said slidable portion moves within said slot between its first and second positions thereby multiplying the motion of said latch arm relative to the linear motion of said portion of said actuating means in said slot and converting the linear movement of said manipulatable elements and said slidable portion of said actuating means within said slot into pivoting of said latch arm between said first and second positions; and (d) a strike for mounting on the associated door frame and engageable with said latch nose when said latch arm is in said second position.

12. The latch assembly in accordance with claim 11 wherein said frame provides means limiting the pivoting of said latch arm between said first and second positions.

13. The latch assembly in accordance with claim 11 wherein said actuating means includes an intermediate elongated portion providing said slidable portion and manipulatable elements at each end extending through said slots in said front and back walls with said manipulatable elements being manipulatable to slide said slidable portion within said inverted V-shaped slot, thereby pivoting said latch arm between said first and second positions.

14. The latch assembly in accordance with claim 13 wherein each of said manipulatable portions includes a projecting portion to facilitate manipulation of said actuating means.

15. The latch assembly in accordance with claim 13 wherein said elongated slidable portion of said actuating means extends between said front and back walls and through said inverted V-shaped slot, and comprises a pair of telescoping members.

16. The latch assembly in accordance with claim 11 including biasing means connected to said latch arm to provide an over center toggle to bias said latch arm into said first and second positions.

17. The latch assembly in accordance with claim 11 wherein there is included a pull pivoted within said housing and having a slot through which said latch arm is pivotable into said second position.

* * * * *